United States Patent [19]

Destree et al.

[11] Patent Number: 4,883,713

[45] Date of Patent: Nov. 28, 1989

[54] MOLDABLE MATERIAL REINFORCEMENT FIBERS WITH HYDRAULIC OR NON-HYDRAULIC BINDER AND MANUFACTURING THEREOF

[75] Inventors: Xavier P. Destree; Angelo A. Lazzari, both of Brussels, Belgium

[73] Assignee: Eurosteel s.a., Brussels, Belgium

[21] Appl. No.: 133,546

[22] Filed: Dec. 16, 1987

Related U.S. Application Data

[63] Continuation-in-part of Ser. No. 857,645, Apr. 28, 1986, abandoned, which is a continuation-in-part of Ser. No. 589,117, Feb. 22, 1984, abandoned.

[51] Int. Cl.[4] ..... B32B 15/00; E04C 5/00

[52] U.S. Cl. ..... 428/397; 52/659; 428/379; 428/399; 428/400; 428/369; 428/362

[58] Field of Search ..... 428/359, 362, 399, 400, 428/364, 397, 379, 369; 52/659

[56] References Cited

U.S. PATENT DOCUMENTS 3,953,953 5/1976 Marsden ..... 52/659

FOREIGN PATENT DOCUMENTS 0715747 2/1980 U.S.S.R. ..... 52/659
0252975 6/1926 United Kingdom ..... 52/659
0772103 4/1957 United Kingdom .

*Primary Examiner*—Lorraine T. Kendell
*Attorney, Agent, or Firm*—Zarley, McKee, Thomte, Voorhees & Sease

[57] ABSTRACT

The invention concerns the reinforcement of a moldable material by means of fibers composed of a filiform body with, at each end, an anchoring device consisting a body in the shape of a solid of revolution, with transversal dimensions exceeding filiform body diameter.

1 Claim, 2 Drawing Sheets

Fig. 1 (PRIOR ART)
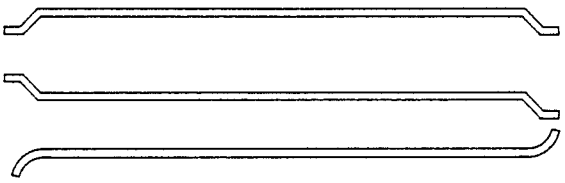
Fig. 2 (PRIOR ART)
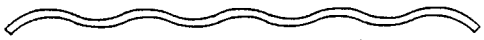
Fig. 3 (PRIOR ART)
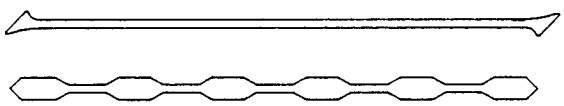
Fig. 4 (PRIOR ART)
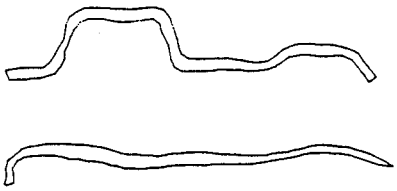
Fig. 5 (PRIOR ART)
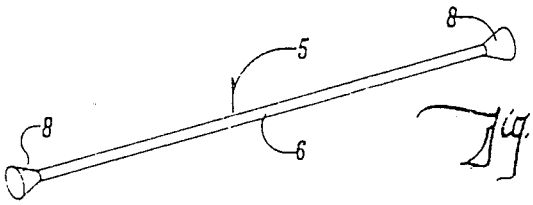
Fig. 6A

MOLDABLE MATERIAL REINFORCEMENT FIBERS WITH HYDRAULIC OR NON-HYDRAULIC BINDER AND MANUFACTURING THEREOF

This is a continuation-in-part application generated from pending continuation-in-part application serial no. 857,645 filed Apr. 28, 1986, now abandoned, which was generated from application serial no. 589,117, filed Feb. 22, 1984, now abandoned.

BACKGROUND OF THE INVENTION

This invention concerns filiform elements, termed fibers, which may be used for the reinforcement of moldable materials with binder of the hydraulic or non-hydraulic type.

The term "fiber" as used in the present specification is understood to mean a filiform element having a length of 30 to 60 mm, a diameter of 0.5–1.0 mm.

Concerning the reinforcement of moldable materials with hydraulic binder, the technique of reinforcing concrete by steel fibers, filiform elements of short length in metal for example, is currently in common use; the properties of the concrete reinforced by these fibers are thus well known and several types of fibers of various origins to be used for specific applications are currently available. In view of their very small dimensions as compared with reinforced rods, the behaviour of the fiber anchorage in the matrix cannot be predicted starting from the anchorage of reinforcing rods.

The various type of fibers are characterized by their reinforcing effect on the composite material, the effect being caused by their geometrical and mechanical characteristics.

The behaviour of a composite material, i.e. a matrix reinforced with fibers is dependent on the effect of the fiber reinforcement in the matrix close to a crack which appears subsequent to the brittleness of the matrix, as the crack had been caused by breaking stress being exceeded due to dimensional variations (thermal, hygrometric) or to bending or tensile stresses.

Ideally, the fiber reinforcement provides an increase in the breaking energy of the composite material compared to the brittle material-matrix.

The increase in the energy required for failure corresponds to the energy required for the elongation and the breaking of the fiber reinforcement.

This explanation of the intervention of the fiber reinforcement clearly shows the necessity to obtain a single body consisting of ductile fibers and brittle matrix.

DESCRIPTION OF THE PRIOR ART

By applying these principles, it is easy to characterize the various types of fibers which are currently available.

(a) Long and straight fibers shown in FIG. 1.

Only adhesion tensions existing along the fiber-matrix interface can cause an anchoring of the fiber in the matrix.

It is shown that to be able to stress the fiber in tension until a tensile stress close to breaking one of obtained, its diameter should be at least 200 times smaller than its length; for practical installation reasons, there is no question of using fibers which would have such geometrical characteristics.

(b) Long fibers provided with hook ends.

Three different types are shown in FIG. 2 and also in British patent 252.975 to Rotinoff referring to FIGS. 1 and 2 of said patent. The existence of end hooks makes it possible to provide anchoring of fiber to matrix.

The fiber behaviour depends on the resistance of the hooks in the matrix.

It is found experimentally that irrespective of the hook geometry (number of opposing curves, radius of curvature), the energy required to open them is always smaller than the tensile breaking stress energy of the fiber; it accordingly follows that often the fibers with hooks are not brought up to a state approaching failure in a crack of the matrix, but are pulled out by opening of the hooks.

In conclusion, it is found that the end hooks, whilst considerably improving the strength of the composite material are, nevertheless, inadequate to obtain ideal behaviour.

(c) Prior art fibers with sine corrugations distributed over their full length.

In this case, the opening energy is again well below the fiber tensile breaking stress energy; the number of corrugations along a fiber does not make up for the excessively large radius of curvature of each corrugation.

These fibers are shown in FIG. 3.

(d) Straight smooth fibers comprising in their length some flattened parts can also be located at their ends.

These fibers are shown in FIG. 4.

Fibers having flattened parts at their ends are disclosed in British patent 252.975 to Rotinoff with reference to FIG. 6.

In this case, the anchoring formed without the bending inducesstiffness loses and it is limited in its effectiveness because it is too aggressive for the matrix.

Actually, as is found experimentally when the fiber is subjected to a tensile stress, the matrix can be sheared by the flattened parts and harmful debonding results.

(e) Rough fibers whether straight or not.

These fibers are shown in FIG. 5.

In this case, the roughness and/or the curves are inadequate to form anchoring.

(f) Fibers having spherical heads, accordingly in the shape of solid of revolution, are disclosed among others in Russian patent 715.747. As stated, the pieces of threads are separated by electrical melting, thus forming a globule at each end of the piece. Quite understandably, melting of the steel changes the properties of the metal at those places where a globule has been formed thus forming weak points. In addition, the shape of the globules is not exactly symmetrical and the transition between the filiform body and the globules is not so smooth as shown. It follows that the heads or globules will easily separate from the remainder of the fiber. This is probably a reason why fiber of that kind are not found on the market.

(g) Fibers of sinuous, hooked or spiral shape are disclosed in British patent 252.975 to Rotinoff with reference to FIGS. 3–5. These fibers have a high tendency of balling together.

(h) Fibers with enlarged heads are disclosed in U.S. patent 3.953.953 to Marsden, more particularly referring to FIG. 9*a* of that patent. While these fibers may achieve some improvement, the results are not completely satisfactory due to the fact that the enlargement of the heads do not extend in all directions starting from the axis of the fiber.

(i) A method for making anchorage heads in the shape of a solid of revolution is disclosed in British patent 772.103 to Kohler in connection with steel rods, i.e. items substantially greater sizes than fibers. While Kohler does not restrict his disclosure to particular dimensions of rods, his invention clearly cannot be applied to fibers in view of the fact that he provides for heat treating the ends of the rod shortly before forging the ends to form an enlarged body. The heat treatment must be of short duration and may affect only a restricted portion of the rod because otherwise the metal is weakened. Such restriction his however not possible with fibers in view of their so small dimensions. This prior art review shows that the ned remains for a proper fiber reinforcement.

OBJECT OF THE INVENTION

Accordingly, an object of the invention consists of a fiber anchoring perfectly with the matrix, that is to say never disbonding because of reasons due to the actual fiber or to the breaking of the matrix near its anchoring means.

With such a type of fiber, the breaking energy of the composite material, would be the one of the brittle matrix, increased by the one of the fiber reinforcement.

This invention more particularly concerns a steel fiber to reinforce a material-matrix consisting of conventional concrete.

SUMMARY OF THE INVENTION

In connection with this, the reinforcing fiber comprises at each end, in accordance with the invention, an anchoring device consisting of one or several bodies of appropriate shape which have transverse dimensions exceeding the diameter of the filiform body.

More particularly the anchoring device is formed at each end of a single shape termed head, which exhibits at least a part generated by symmetrical revolution.

It has been found that the required fiber should have a filiform body with, at each end, a head with the inside part, that is to say the part in contact with the filiform body is of the shape of a solid of revolution defined by a generating curve or time so that the angle between the tangent at any point of the generating curve and the axis of the filiform body has a maximum value between 20° and 60°. To obtain ideal behaviour, the value of this angle will depend on the nature of the material forming the fiber.

As an example, steel for very low mechanical grades requires correspondingly high head angles and for high mechanical grades requires the lowest angle heads.

The filiform constituents termed fibers described above can be made by using several processes.

Actually, in accordance with a preferred process, a filiform body of indefinite length with diameter equal to the diameter intended for the fiber shank is cut so as to produce fibers of exact length. The following stage of that process is undertaken by striking a hammer on each end of a filiform body, without head, of a diameter equal to the fiber body, each end being held when it is struck by a matrix so as to obtain a head of the required shape.

BRIEF DESCRIPTION OF THE DRAWINGS

FIG. 1 represents prior art long and straight fibers

FIG. 2 represents prior art long fibers with hooked ends

FIG. 3 represents prior art fibers with sine corrugations

FIG. 4 represents prior art straight smooth fibers comprising in their length some flattement parts FIG. 5 represents prior art rough fibers.

FIG. 6A represents at a slightly enlarged scale and in perspective view a fiber according to the invention.

BEST MODE OF EXECUTION OF THE INVENTION

Figure 6B:
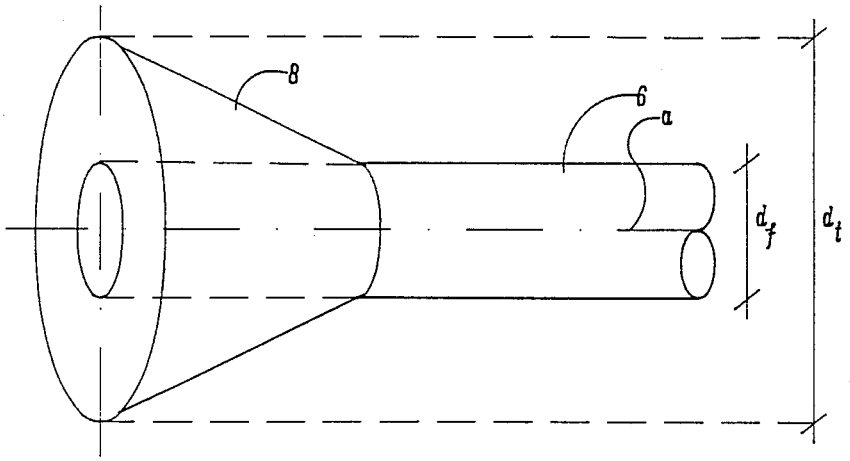
FIG. 6B represents at a greatly enlarged scale the end portion of the fiber of FIG. 6A

As shown in FIGS. 6A and 6B, the fiber of the invention designated 5 comprises a filiform body or shank 6 and at each end thereof a tread or bulge 8 of greater diameter. Preferably each head 8 being of enlarged diameter (maximum dt) as compared with the diameter df of the shank portion 6, is in the form of a cone. The important feature is that the head is in the form of a solid of revolution such being defined by a generating line or curve. In the case of the conical head shown in FIG. 6B, the generating line is straight but is should be understood that similar, rounded shapes could be encompassed wherein the solid revolution of the head is defined by a generating curve. In those instances, there should be taken care to provide such a head shape that the angle formed by the tangent at any point of said generating curve forms with the longitudinal axis a of the fiber an angle the maximum value of which lies somewhere between 20° and 60°, which means that said angle may in no way be greater than 60°.

Figure 7:
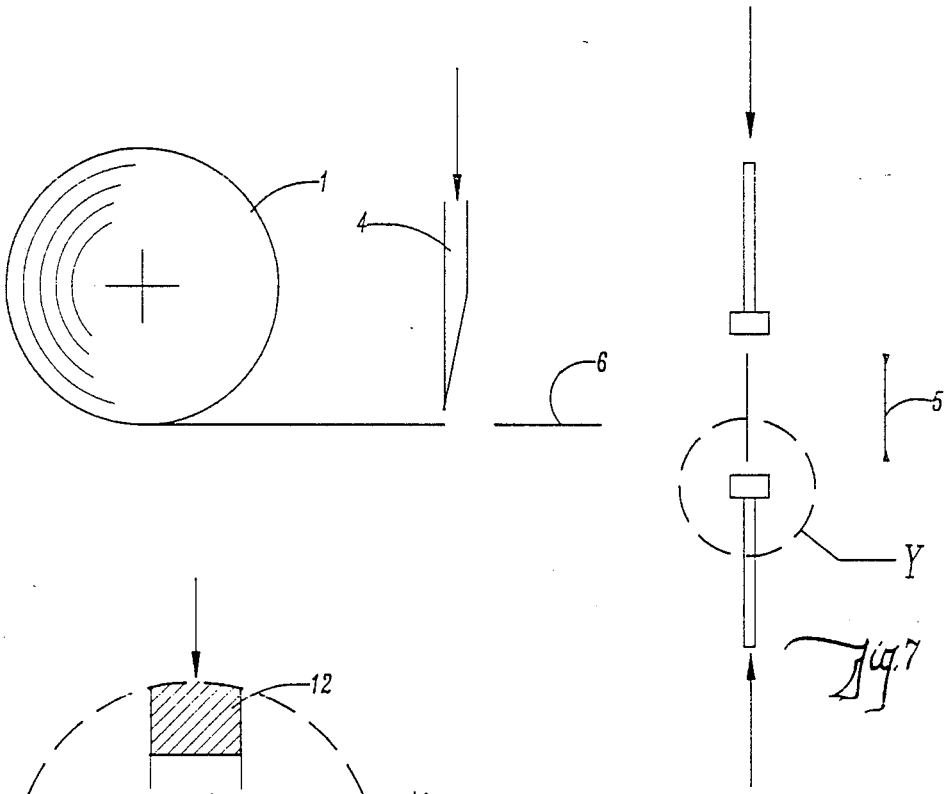
FIG. 7 represents schematically an equipment to manufacture the fibers of the invention and FIG. 8 represents the cross sections of detail Y of FIG. 7.
Figure 8:
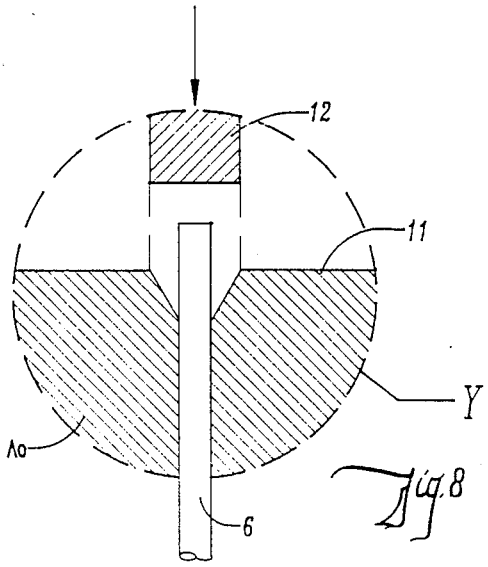

In the preferred method illustrated in FIG. 7 and 8, the coiled wire generally designated by reference 1 and having the diameter (e.g. 1 mm) intended for the final fiber is drawn towards a shearing device 4 which produces filiform bodies 6, straight, of constant short length e.g. 58 mm.

Thereafter, each filiform body 6 is nipped at its ends between forming members 10 and 11 such as shown in FIG. 8 and struck by hammers such as 12 to provide the required heads 8 in their exact (here conical) shape.

We claim:

1. A reinforcing fiber for use in reinforcing a moldable matrix material, comprising:

an elongated cylindrical steel body having opposite ends, and a longitudinal axis, and a head at each end thereof; said heads being substantially symmetrical with said axis and being substantially conically shaped, and extending longitudinally and radially outwardly from the ends thereof to create a substantially conically shaped surface, whereby the tangent at any point on said conically-shaped surface forms an angle with said axis between 20° and 60°; said heads being formed by mechanically deforming the ends of said elongated cylindrical steel body.

* * * * *